US008850859B2

(12) United States Patent
Wang et al.

(10) Patent No.: US 8,850,859 B2
(45) Date of Patent: Oct. 7, 2014

(54) ANTI-THEFT LOCKSET

(71) Applicants: Le-Qun Xu, Wenzhou/Zhejiang (CN); Chieh Wang, New Taipei (TW)

(72) Inventors: Chieh Wang, New Taipei (TW); Wei Wang, New Taipei (TW)

(73) Assignees: Le-Qun Xu (CN); Chieh Wang (TW)

( * ) Notice: Subject to any disclaimer, the term of this patent is extended or adjusted under 35 U.S.C. 154(b) by 0 days.

(21) Appl. No.: 13/906,522

(22) Filed: May 31, 2013

(65) Prior Publication Data

US 2013/0319057 A1 Dec. 5, 2013

(30) Foreign Application Priority Data

May 31, 2012 (CN) ..... 2012 1 0174958

(51) Int. Cl.
*E05B 27/00* (2006.01)
*E05B 27/02* (2006.01)
*E05B 29/00* (2006.01)

(52) U.S. Cl.
CPC ..... *E05B 27/02* (2013.01); *E05B 29/004* (2013.01); *E05B 29/0066* (2013.01)
USPC ..... 70/492; 70/496; 70/376; 70/384

(58) Field of Classification Search
USPC ..... 70/492, 384, 496, 376
See application file for complete search history.

(56) References Cited

U.S. PATENT DOCUMENTS

| | | | | |
|---|---|---|---|---|
| 6,871,520 | B2 * | 3/2005 | Armstrong et al. | 70/492 |
| 6,959,569 | B2 * | 11/2005 | Strader et al. | 70/492 |
| 7,007,528 | B2 * | 3/2006 | Chong et al. | 70/492 |
| 7,234,331 | B2 * | 6/2007 | Armstrong et al. | 70/492 |
| 7,322,219 | B2 * | 1/2008 | Armstrong et al. | 70/492 |
| 7,434,431 | B2 * | 10/2008 | Armstrong et al. | 70/492 |
| 7,448,239 | B1 * | 11/2008 | Huang et al. | 70/360 |
| 7,448,240 | B1 * | 11/2008 | Huang et al. | 70/492 |
| 7,712,344 | B2 * | 5/2010 | Shen | 70/495 |
| 7,874,191 | B2 * | 1/2011 | Chiang et al. | 70/492 |
| 7,878,036 | B2 * | 2/2011 | Armstrong et al. | 70/492 |
| 7,900,491 | B2 * | 3/2011 | Chong | 70/492 |
| 8,099,988 | B1 * | 1/2012 | Wheatland | 70/383 |
| 8,117,876 | B2 * | 2/2012 | Mathachan | 70/492 |
| 8,291,735 | B1 * | 10/2012 | Damikolas | 70/383 |
| 8,490,446 | B2 * | 7/2013 | Rao et al. | 70/383 |
| 8,621,902 | B2 * | 1/2014 | Mathachan | 70/492 |
| 2011/0041577 | A1 * | 2/2011 | Zhang | 70/384 |
| 2012/0247163 | A1 * | 10/2012 | Damikolas | 70/492 |
| 2013/0086957 | A1 * | 4/2013 | Emory | 70/492 |

* cited by examiner

*Primary Examiner* — Suzanne Barrett

(57) ABSTRACT

Anti-theft lockset is disclosed. Lock column and frame body are arranged in lock core. Outer side of lock column is matched with a long slot on the inner wall of lock shell. Inner side of lock column is provided with a crown pillar, and lock core is provided with a sliding chute for causing lock column to slide and a first through hole for causing frame body to move. Crown pillar is contacted with a first lock ball. Lock core is internally provided with lock ball holes matched with first and second lock balls. One end of the second lock ball is contacted with the frame body. The lock core is provided with a containing slot for causing the first lock ball and a locking plate to move up and down. The containing slot is communicated with a key hole. The locking plate is provided with a second through hole.

6 Claims, 18 Drawing Sheets

ANTI-THEFT LOCKSET

FIELD OF THE INVENTION

This invention relates to the field of hardware products, and more particularly, to a lockset.

BACKGROUND OF THE INVENTION

There are variety kinds of locks with different constructions on the market. Many of the locks possess good performance on anti-theft. The most common locks are pin tumbler locks. However, the pin tumbler locks are one of the locks to be destroyed easiest.

China publication patent, CN102199954A, discloses a theft-proof lock which comprises a lock shell, a lock core and a ball, wherein the lock core is provided with a key hole. The lock core is provided with accommodating slots into which the ball can be inserted. The accommodating slots are formed on two sides of the key hole, and springs are arranged in the accommodating slots. The ball is provided with a V-shaped groove, and one side of the ball opposite to the V-shaped groove is provided with a lock post; mutually symmetrical transverse slots are formed in the axial direction of the lock core. The transverse slots are communicated with the accommodating slots, transverse pins are arranged in the transverse slots. One side of the transverse pin opposite to the central line of the lock core is provided with a V-shaped face, and the V-shaped face is matched with the V-shaped groove; and the inner wall of the lock shell is provided with an elongated slot matched with the transverse pins. The theft-proof lock is characterized in that: the end of the elongated slot is provided with a circular hole, a magnet is arranged in the circular hole, and the transverse pins are connected with the magnet. The anti-theft lock aforementioned is easily to be damaged, especially to the ball. Moreover, the anti-theft performance of the lock aforementioned is not acceptable due to the keys and the locks are single matched.

SUMMARY OF THE INVENTION

One of objects of the present invention is to provide a novel anti-theft lockset with novel structure and good theft-proof performance.

To achieve the abovementioned object, the invention provides a novel anti-theft lockset, comprising a lock core and a lock shell, a locking plate, a first lock ball and a second lock ball being disposed in the lock core, and a long slot being disposed on the inner wall of the lock shell, a key hole being disposed on the lock core and the locking plate being disposed in the key hole; wherein a lock column and a frame body are arranged in the lock core and the lock column is connected with the frame body; wherein the outer side of the lock column is matched with the long slot on the inner wall of a lock shell; wherein the inner side of the lock column is provided with a crown pillar, and the lock core is provided with a sliding chute which is used for causing the lock column to slide and a first through hole which is used for causing the frame body to move; wherein the crown pillar is contacted with the first lock ball; wherein the lock core is internally provided with lock ball holes which are matched with the first lock ball and the second lock ball and the second lock ball is arranged in the lock ball holes; wherein one end of the second lock ball is contacted with the frame body and the lock core is provided with a containing slot which is used for causing the first lock ball and the locking plate with teeth on the two sides to move up and down; wherein the first lock ball is provided with an edge structure, and the edge of the edge structure is matched with a tooth space in a second through hole of the locking plate; wherein the lock core is also provided with an elastic device, and the elastic device is contacted with the locking plate; and wherein the lock core is internally provided with a spring, one end of the spring is contacted with the lock column, and the other end of the spring is contacted with a step in the lock core.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure. The details and technology of the present invention are described below with reference to the accompanying drawings:

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
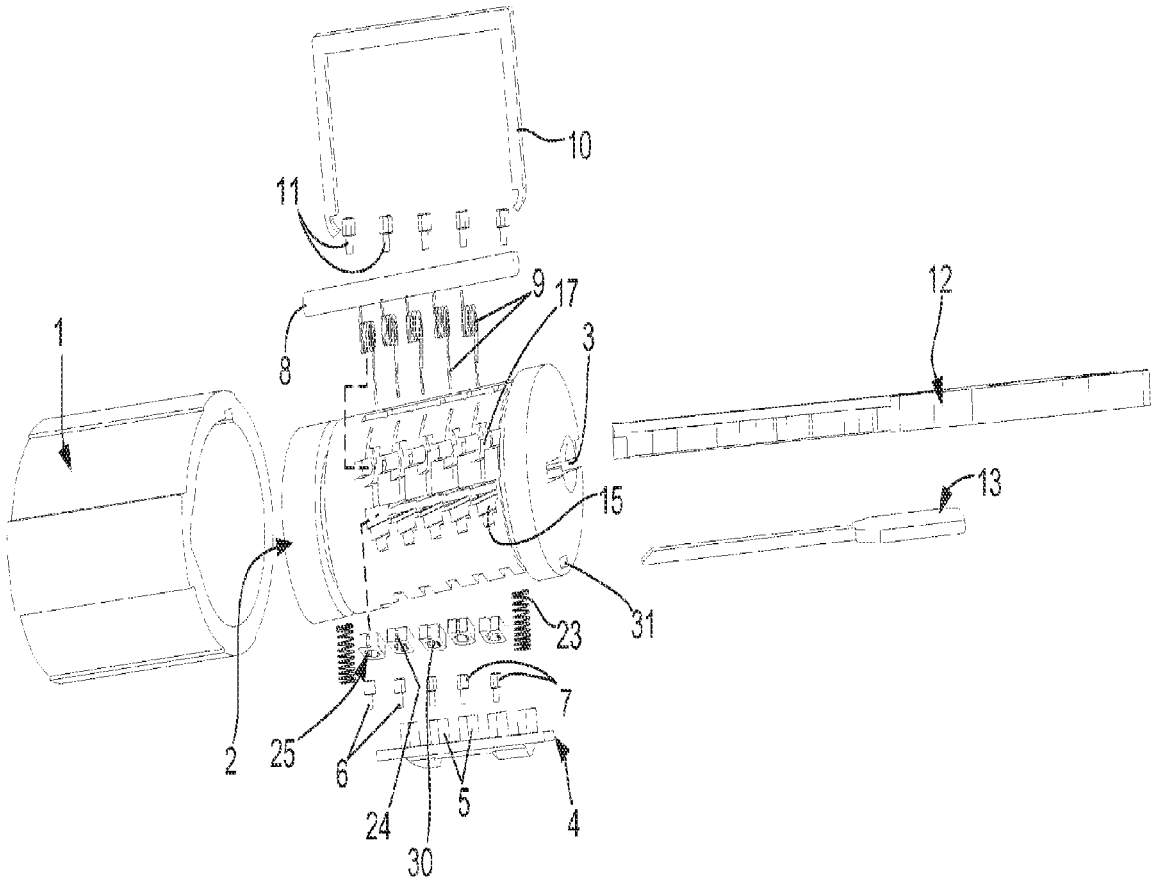
FIG. 1 is a structure diagram of the present invention.
Figure 2:
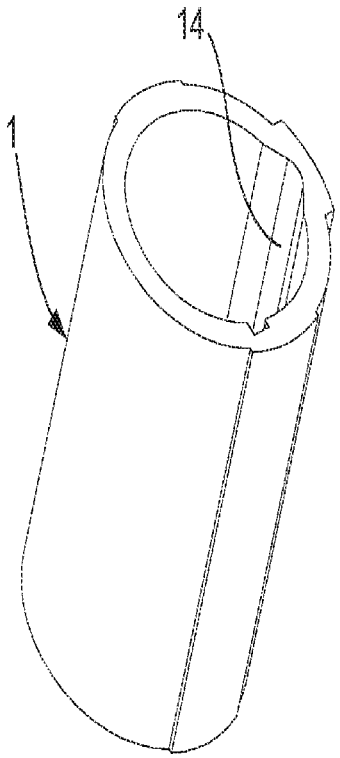
FIG. 2 is a structure diagram of the lock shell of the present invention.
Figure 3:
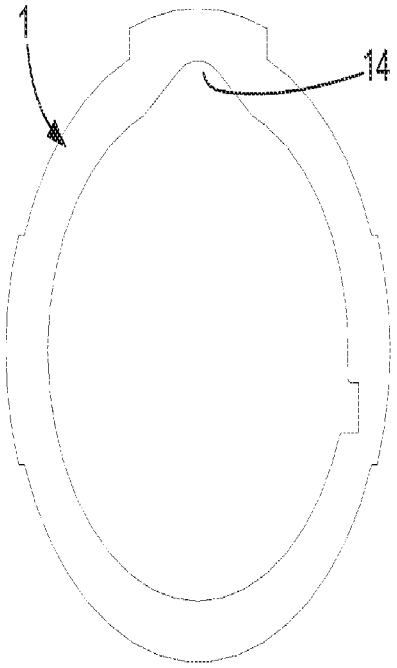
FIG. 3 is a cross-section diagram of the lock shell of the present invention.
Figure 4:
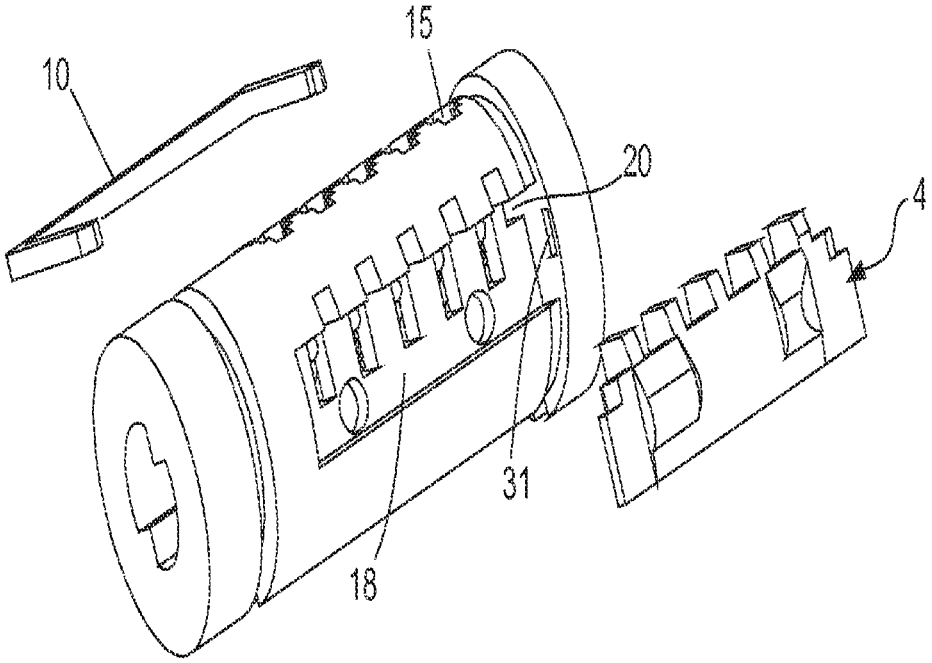
FIG. 4 is a structure diagram of the lock core of the present invention.
Figure 5:
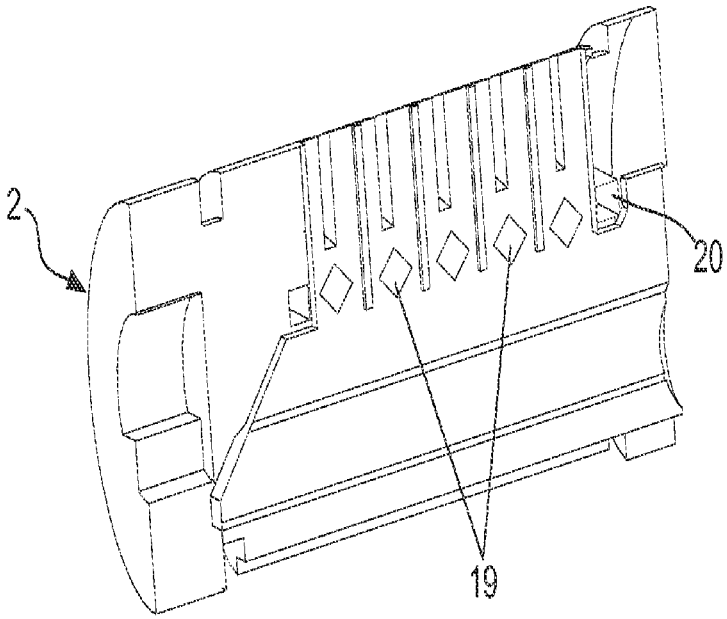
FIG. 5 is a cross-section diagram of the lock core of the present invention.
Figure 6:
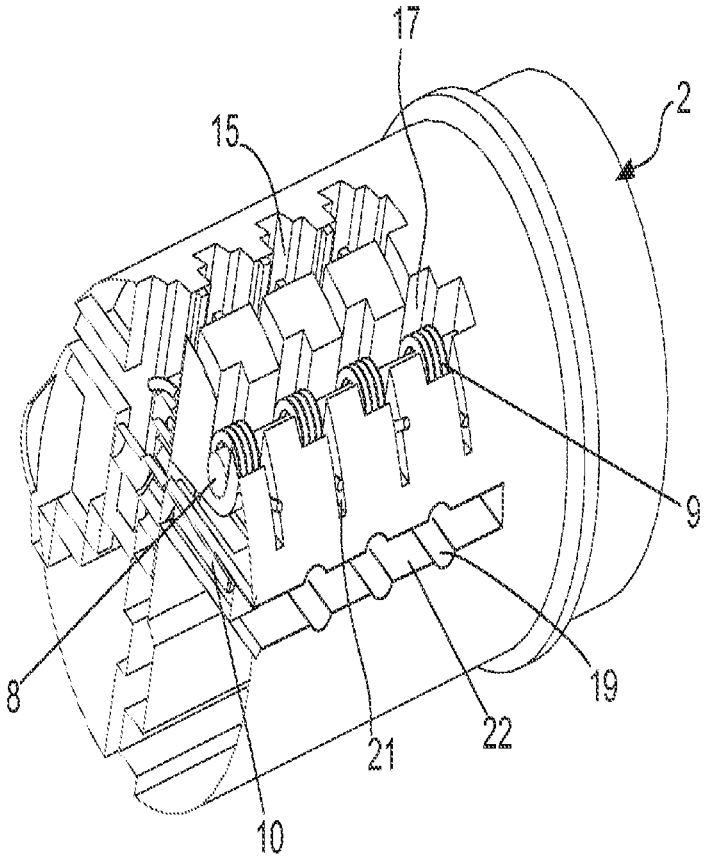
FIG. 6 is a part cross-section diagram of the lock core of the present invention.
Figure 7:
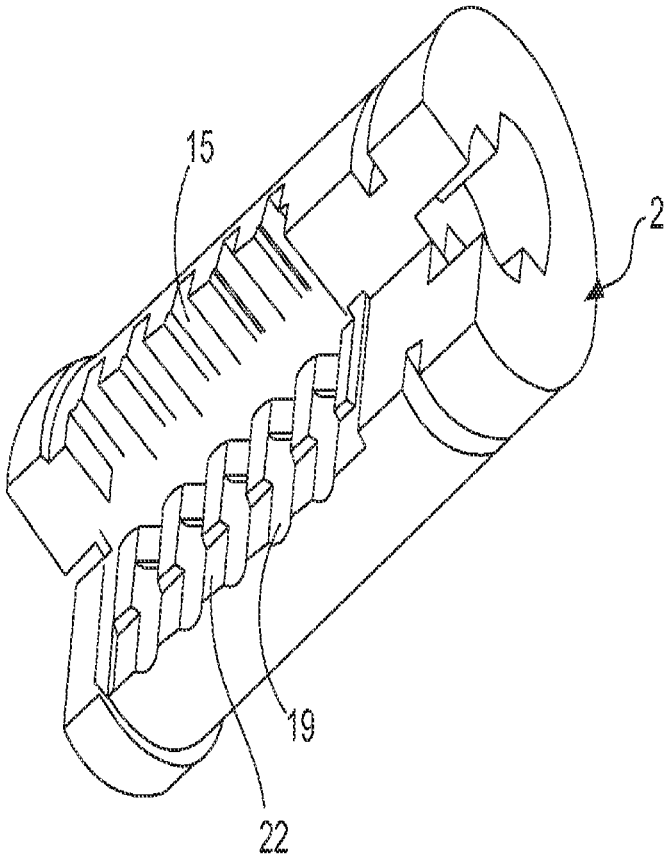
FIG. 7 is another part cross-section diagram of the lock core of the present invention.

As shown in FIG. 1 and FIG. 2, the novel anti-theft lockset is mainly comprises a lock core 2 and a lock shell 1. A locking tongue 25, a first lock pillar 6 and a second lock pillar 11 is disposed in the lock core 2, and one end of the locking tongue 25 is matched the configuration of a key 12. A long groove 14 is disposed on the inner wall of the lock shell 1, a key hole 3 is disposed on the lock core 2 and the locking tongue 25 is disposed in the key hole 3. A lock column 4 and a frame body 10 are arranged in the lock core 2 and the lock column 4 is connected with the frame body 10. As shown in FIG. 1, FIG. 4 and FIG. 6, the frame body consists of a lateral bar and two vertical posts. The outer side of the lock column 4 is matched with the long groove 14 on the inner wall of the lock shell 1. The lock column 4 is arranged in the long groove 14 while locked for causing the long groove 14 and the inner wall of the lock shell 1 connected with a curve surface. As shown in FIG. 3, the lock column 4 is easily to slide in and out of the long groove 14 due to the smooth contacting between the long groove 14 and the inner wall of the lock shell 1.

As shown in the remaining figures, the inner side of the lock column 4 is provided with a support pillar 5, and the lock core 2 is provided with a sliding slot 18 which is used for causing the lock column 4 to slide and a frame body sliding slot 20, wherein the frame body sliding slot 20 is formed in the sliding slot (18) of the lock core (2) and communicated with the accommodating slots (15), so as to be used for causing the frame body 10 to move. The support pillar 5 is contacted with the first lock pillar 6, and the lock core 2 is internally provided with lock pillar grooves 19 which are matched with the first lock pillar 6 and the second lock pillar 11. The second lock pillar 11 is arranged in the lock pillar grooves 19 and one end of the second lock pillar 11 is contacted with the frame body 10. The lock core 2 is provided with an accommodating slot 15 which is used for causing the first lock pillar 6 and the locking tongue 25 to move up and down. The accommodating slot 15 is communicated with a key hole 3. The locking tongue 25 is provided with a second through hole 30 with teeth on the two sides. Four V-shaped grooves 26 are forming between teeth 27 disposed on both sides of the second through hole 30 of the locking tongue 25. The first lock pillar 6 is provided with an rhombus-shaped structure 7 and the cross-section of which is rhombus. The edge of the rhombus-shaped structure 7 is matched with one of the V-shaped groove 26 in a second through hole 30 of the locking tongue 25. After the rhombus-shaped structure 7 of the first lock pillar 6 is arranged in the second through hole 30 of the locking tongue 25, the locking tongue 25 will be locked, and the rhombus-shaped structure 7 of the first lock pillar 6 will be moved up and down following the locking tongue 25. The lock core 2 is also provided with an elastic device and the elastic device comprises a cross bar 8 and a torsion spring 9 which is worn around the cross bar 8.

Figure 8:
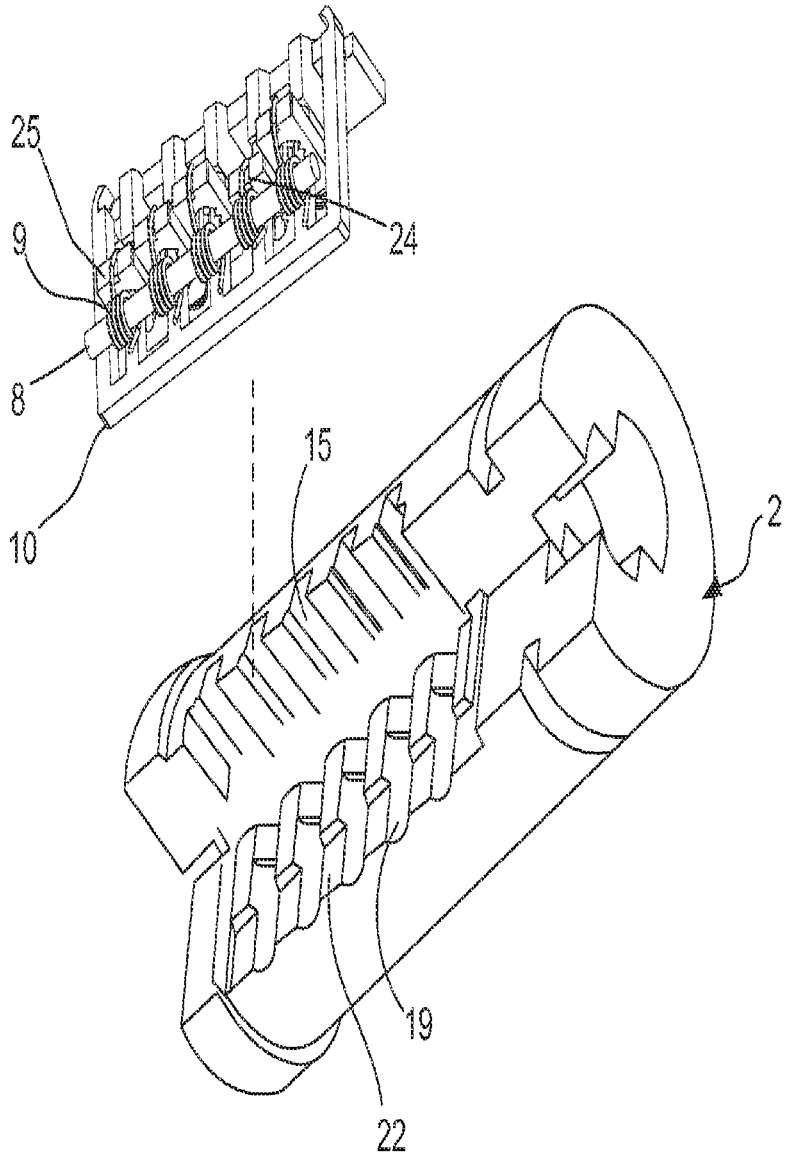
FIG. 8 is a structure diagram with removing the frame body in FIG. 7.
Figure 9:
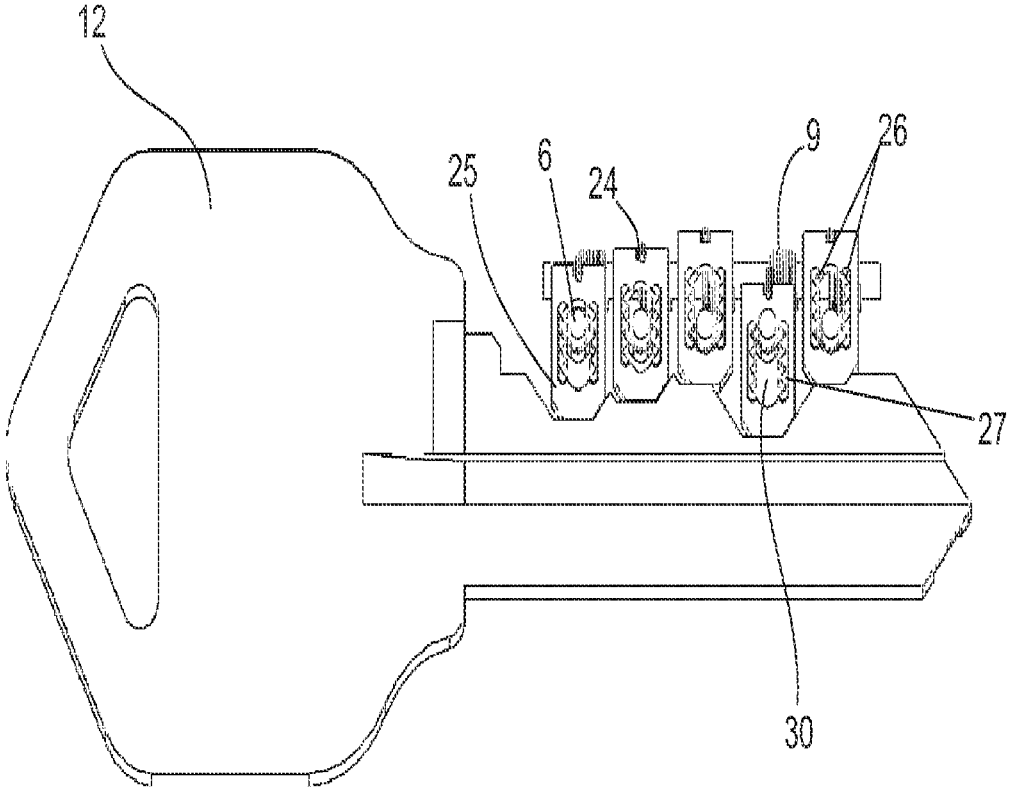
FIG. 9 is a structure diagram with inserting the key into the key hole.

A first recess slot 17 is provided on the side surface of the lock core 2. As shown in FIG. 6, the torsion springs (9) are respectively disposed in the first recess slots (17), and the cross bar (8) is disposed in the first recess slots (17) for passing through the torsion springs (9), so as to keep the torsion springs (9) in the first recess slots (17). A second accommodating slot 22 is provided on the side surface of the lock core 2 and adjacent to the second recess slots (21), wherein the second accommodating slot 22 is used for causing the lateral bar of the frame body 10 to move. The second accommodating slot 22 passes through all of the lock pillar grooves 19. As shown in FIG. 6 and FIG. 8, a second recess slot 21 is provided on the corresponding radial position of the lock core 2, wherein one end of the torsion spring 9 is placed in the second recess slot 21. Therefore, the lock core 2 is used as a force bearing point of the torsion spring 9. Moreover, the other end of the torsion spring 9 is contacted with the locking tongue 25. A curve slot 24 is provided on the top end of the locking tongue 25 and the other end of the torsion spring 9 is fixed and unmovable by placing in the curve slot 24 via the communication channel between the first recess slot (17) and the accommodating slot (15). By such design and element arrangement, the force provided by the torsion spring 9 can be evenly applied to the top end of each of the locking tongues 25, thus, the unlocking accuracy is improved. The lock core 2 is internally provided with a spring 23. One end of the spring 23 is contacted with the lock column 4, and the other end of the spring 23 is contacted with a step 29 in the lock core 2. The spring 23 pushes the lock column 4 moving out of the sliding slot 18 and arranged in the long groove 14 of the lock shell 1 when locked. After the rhombus-shaped structure 7 of the first lock pillar 6 being placed in the second through hole 30 of the locking tongue 25, the rhombus-shaped structure 7 of the first lock pillar 6 is hooked up with the locking tongue 25 and will be moved up and down following the locking tongue 25.

An inserting hole 31 is provided on eccentric position of the lock core 2 and communicated with the sliding slot 18. A inclined plane 28 is provided on one end of the lock column 4 near the inserting hole 31. After an inserting plate 13 with an inclined plane inserting into the inserting hole 31, the lock column 4 enters the sliding slot 18 for replacing the key.

The unlocking theorem of the present invention is described as follows. After inserting the matched key 12 into the key hole 3 during unlocking, teeth on the key 12 pushes the corresponding locking tongue 25 going up for causing all of the first lock pillars 6 in the second through hole of the locking tongue 25 placed on the same line. Now, all of the first lock pillars 6 and the second lock balls 11 in the lock pillar grooves 19 are aligned. The lock column 4 is moved out from the long groove 14 of the lock shell 1 when the lock core is rotated. After the lock column 4 moving out of the long groove 14 of the lock shell 1, the lock column 4 is moved into the sliding slot 18 of the lock core 2, such that the outer bottom surface of the lock column 4 is flush with the side surface of the lock core 2. During the lock column 4 moving into the sliding slot 18 of the lock core 2 from the long groove 14 of the lock shell 1, the frame body 10 moves together with the lock column 4 in the frame body sliding slot 20. The support pillar 5 on the lock column 4 is contacted with the first lock pillar 6. The rhombus-shaped structure 7 of the first lock pillar 6 is partially moved in to the lock pillar grooves 19 when the first lock pillar 6 and the second lock pillar 11 are contacted. Now, the spring is forced. After the lock core 2 rotating 90 degrees, the lockset is unlocked.

The lock core 2 is reverse rotated 90 degrees when locked. The long groove 14 on inner wall of the lock shell 1 is aligned to the sliding slot 18 of the lock core 2. The frame body 10 moves together with the lock column 4 by the force of the spring 23 for causing the lock column 4 moving out of the sliding slot 18 and moved into the long groove 14 on inner wall of the lock shell 1. During the frame body moving, the second lock pillar 11 is moved in the lock pillar grooves 19 for causing the first lock pillar 6 moving out of the lock pillar grooves 19. The first lock pillar 6 is capable of moving up and down in the accommodating slot 15. After pulling out the key 12, the torsion spring 9 forces the locking tongue 25 and presses down the locking tongue 25 in the accommodating slot 15. The first lock pillar 6 is moved down when the locking tongue 25 is pressed down. Now, the first lock pillar 6 and the second lock pillar 11 are misalignment. All of the first lock pillars will not be arranged on the same line again nor did corresponding contact to the second lock pillar 11 by using the unmatched key. Thus, the frame body 10 and the lock column 4 are unmovable and the lock column 4 cannot be moved out from the long groove 14 of the lock shell 1. Therefore, the novel anti-theft lockset is at a locked situation, and the internal structure of the lock core 2 is difficult to destroy and the ability of anti-theft is improved.

Figure 10:
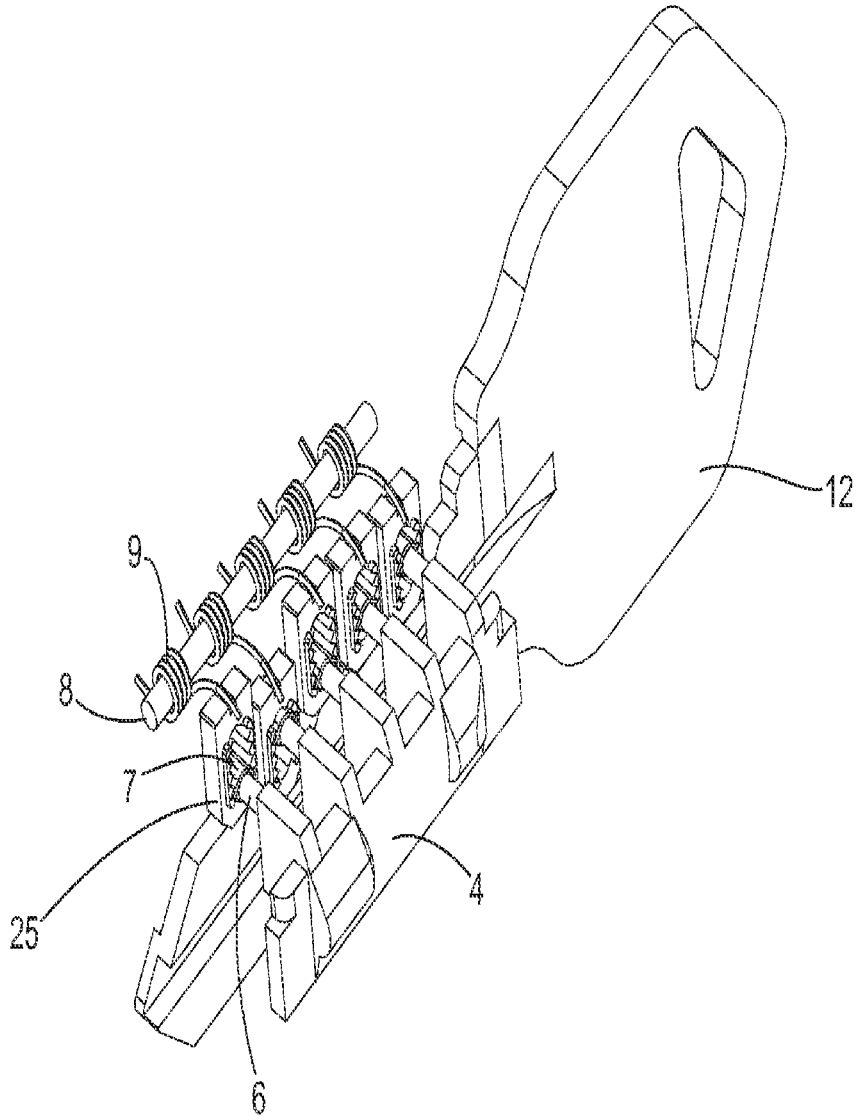
FIG. 10 is a structure diagram in other direction view of FIG. 7.
Figure 11:
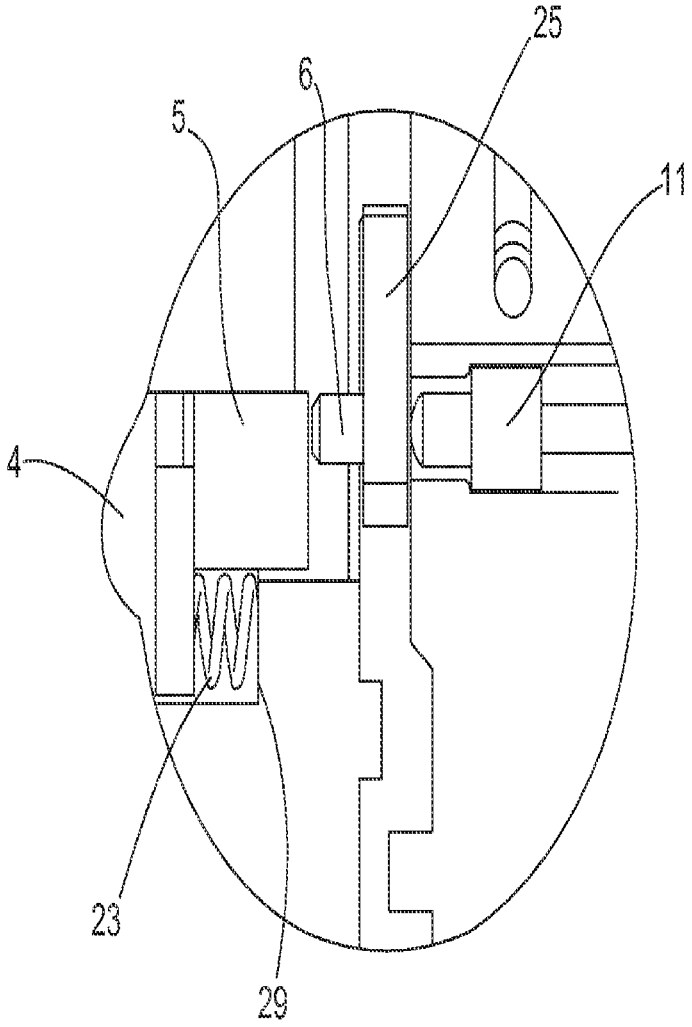
FIG. 11 is an unlocked matching structure diagram of the lock column, the first lock ball and the second lock ball of the present invention.
Figure 12:
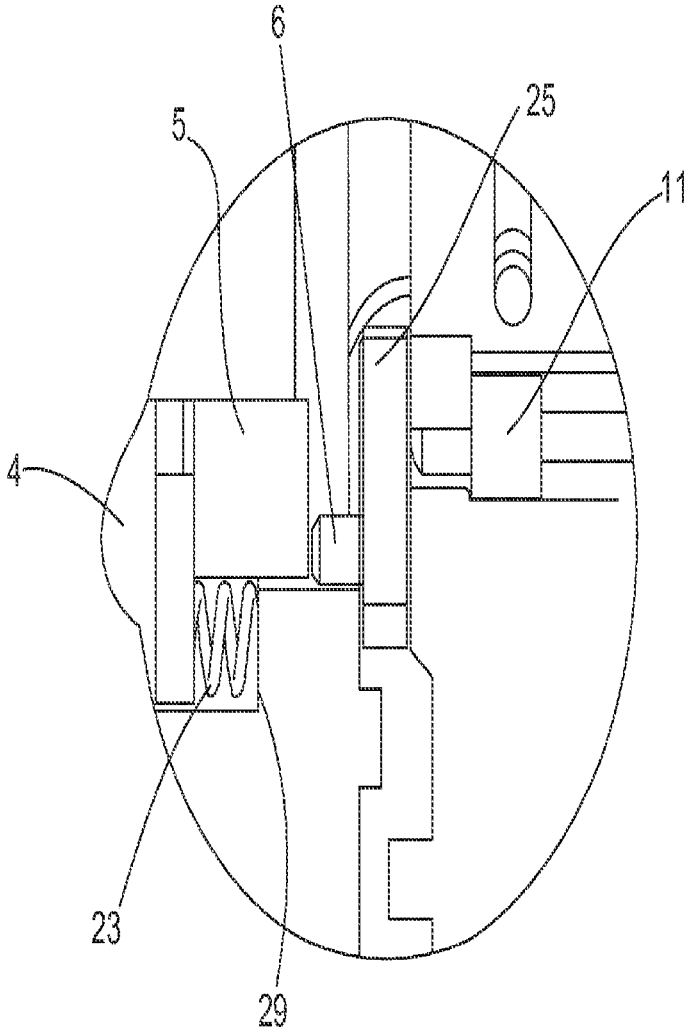
FIG. 12 is a locked matching structure diagram of the lock column, the first lock ball and the second lock ball of the present invention.
Figure 13:
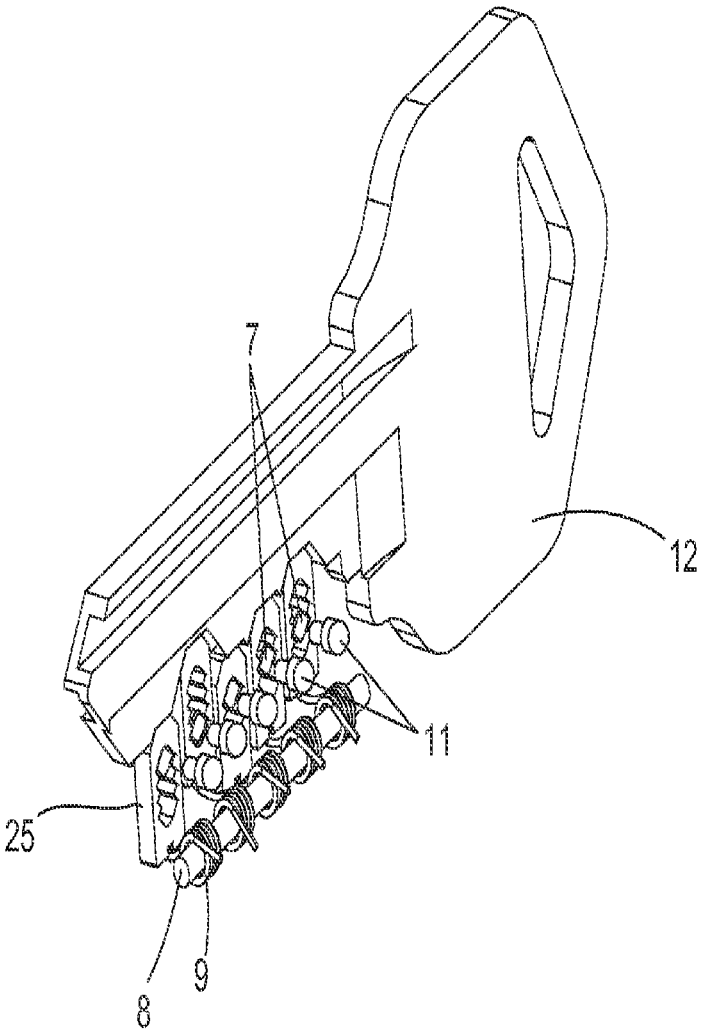
FIG. 13 is a position diagram of first lock ball of the present invention when the key is replaced.
Figure 14:
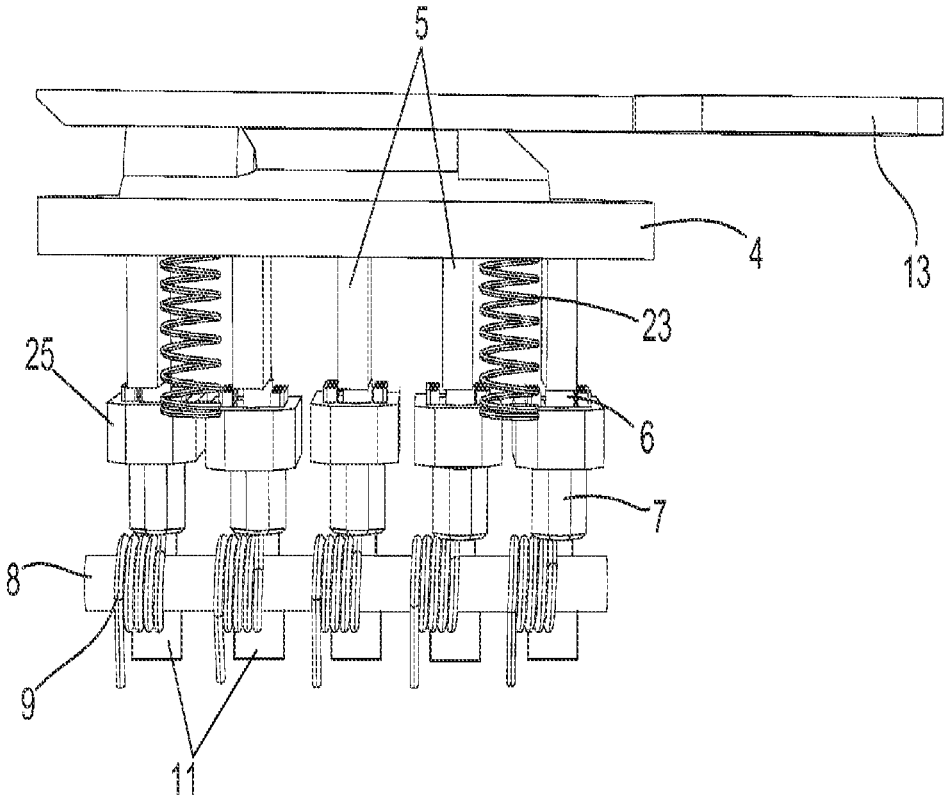
FIG. 14 is a plane structure diagram of first lock ball of the present invention when the key is replaced.
Figure 15:
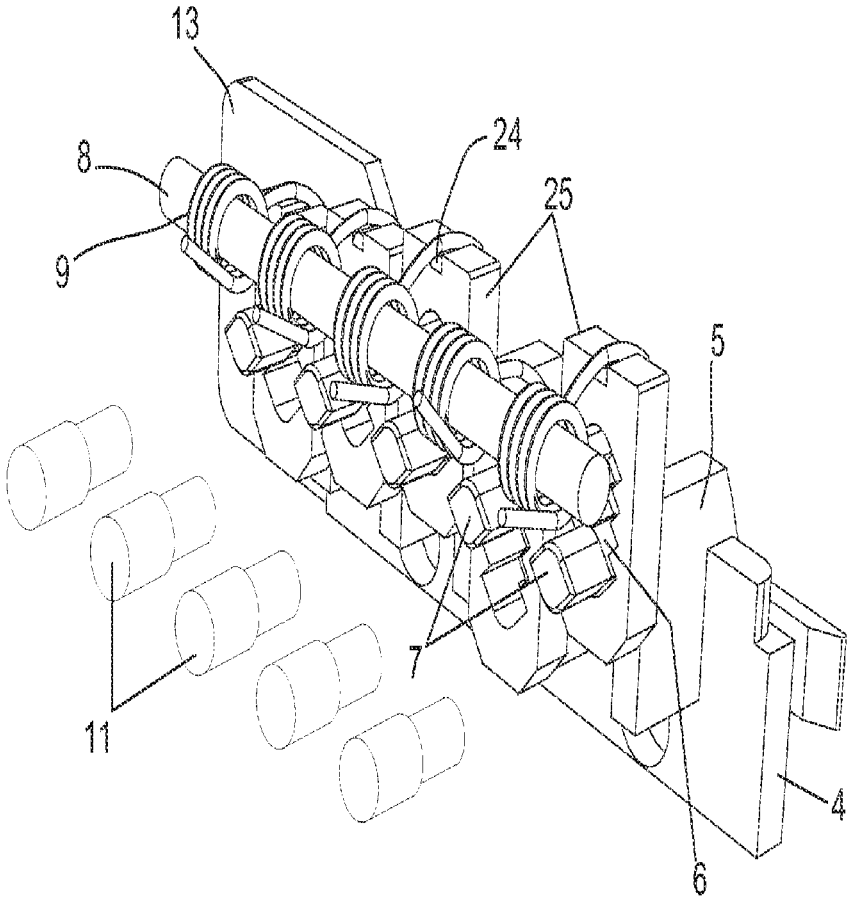
FIG. 15 is a structure diagram in other direction view of FIG. 7.
Figure 16:
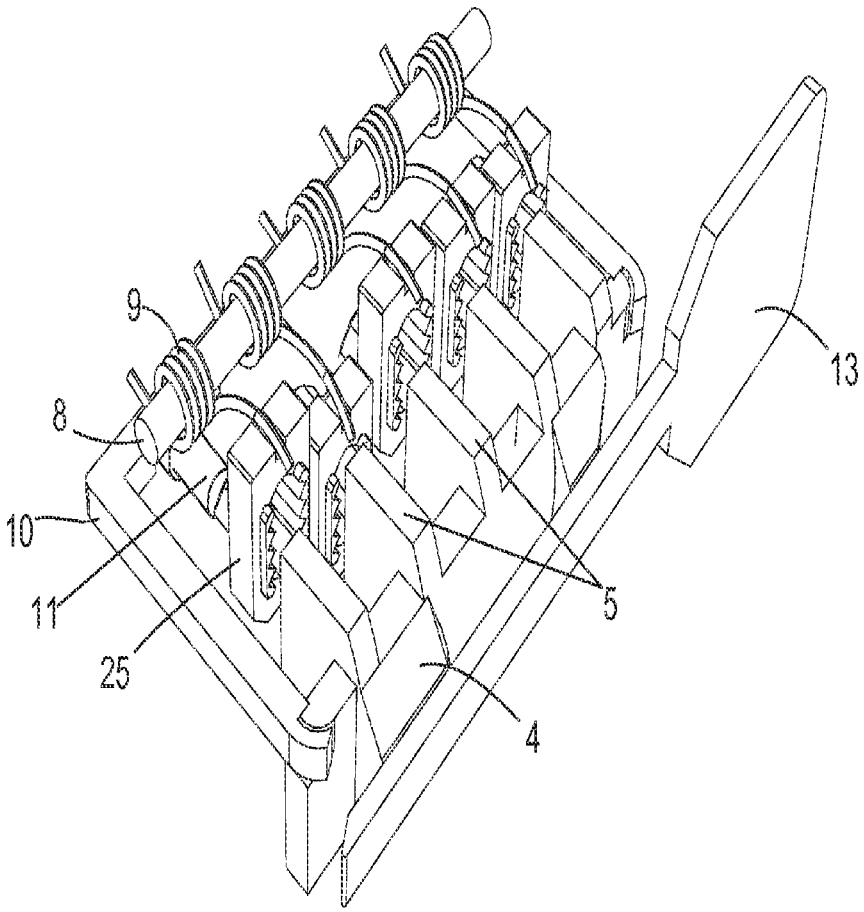
FIG. 16 is a structure diagram with the frame body and the second lock ball of the present invention being connected to each other.
Figure 17:
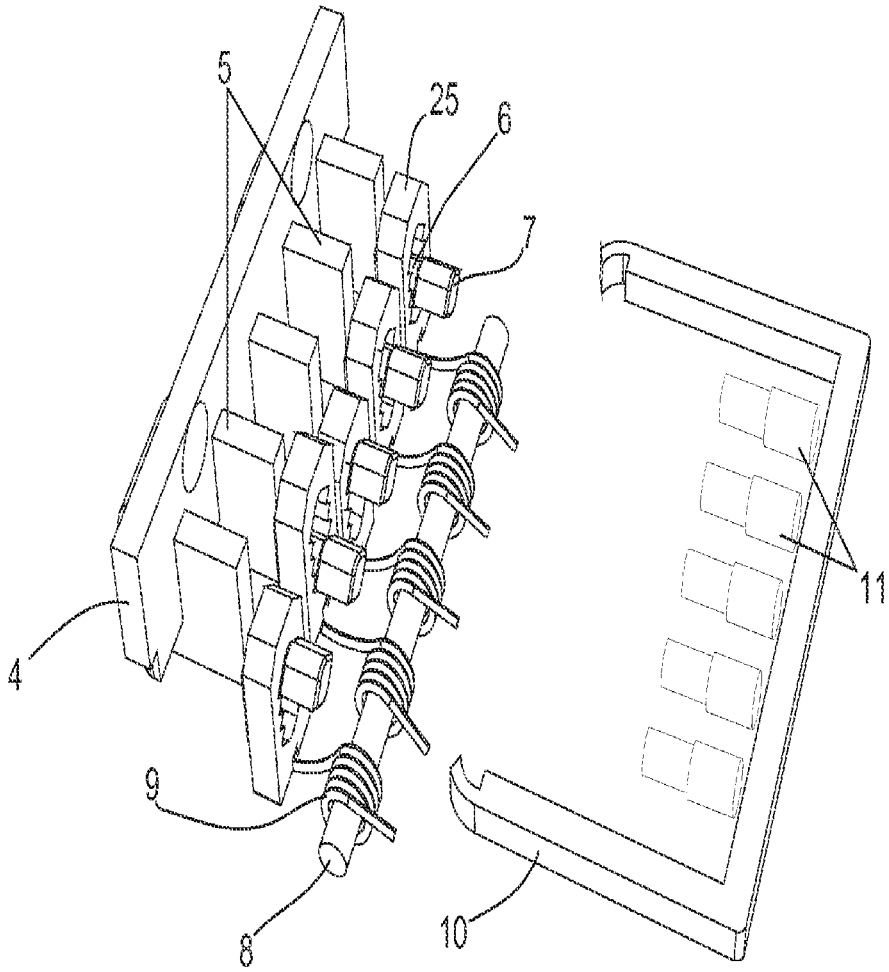
FIG. 17 is a matching structure diagram of frame body, the lock column, the crown pillar, the first lock ball and the second lock ball of the present invention.
Figure 18:
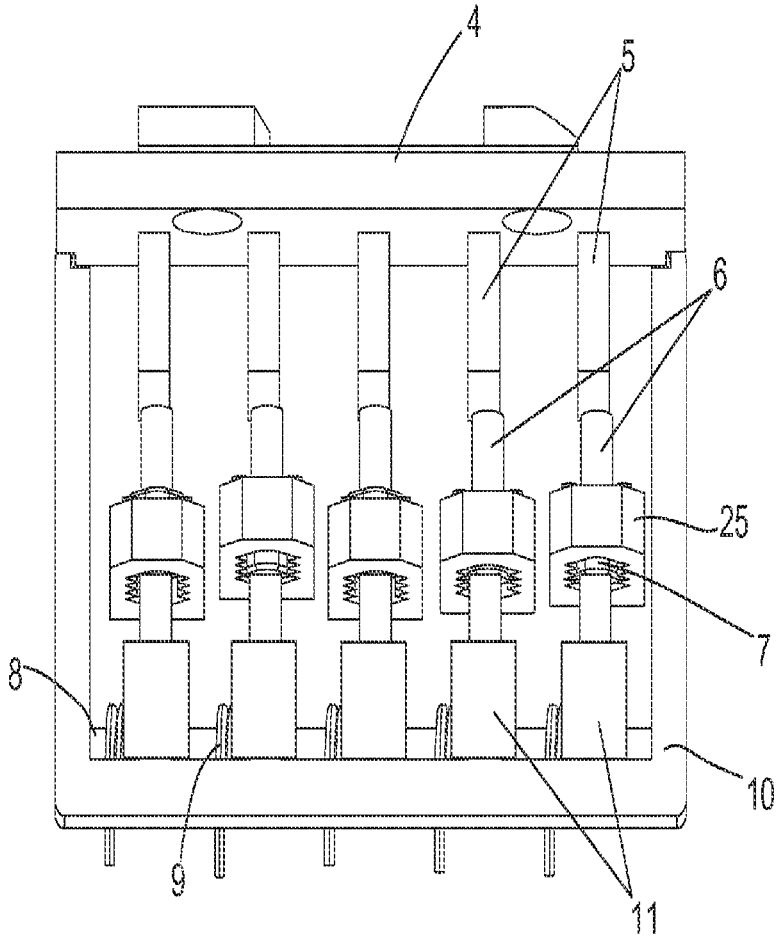
FIG. 18 is a vertical view of FIG. 17.

For insurance, the key 12 is replaceable when the key is lost or the teeth of the key are ineffective. The theorem of which is described as follows. The position of the teeth of the new key is the same to the old one. Only the depth of the teeth of new key and old one is different. The lock core 2 is unlocked when the lock core is rotated 90 degrees by inserting the old key into the key hole 3. Now, the inserting plate 13, which the shape is similar to plate-shape, is inserted into the inserting hole 31 on eccentric position of the lock core 2. After inclined plane of the inserting plate 13 matched the inclined plane 28 of the lock column 4 in the sliding slot 18, the lock column is moved again in the sliding slot 18. As shown in FIG. 10, FIG. 11, and FIG. 12, the support pillar 5 of the lock column 4 is connected to the first lock pillar 6, and the second lock pillar 11 is connected to the first lock pillar 6, such that the first lock pillar 6 and the second lock pillar 11 move in the lock pillar grooves 19 due to the action of the support pillar 5. The rhombus-shaped structure 7 of the first lock pillar 6 is fully moved out from the V-shaped grooves 26 of the second through hole 30 of the locking tongue 25. After the spring 23 being forced, the old key is pulled out and a new one is inserted. After inserting plate 13 being also pulled out, the lock column 4 moves at reverse direction in the sliding slot 18 by the spring 23 force and the frame body 10 is moved together. When the frame body 10 moves, the second lock pillar 11 is moved for causing the first lock pillar 6 moved out from the lock pillar grooves 19 and the rhombus-shaped structure 7 of the first lock pillar 6 moves into the through hole 30 of the locking tongue 25. After the new key inserted, the height position of each locking tongue 25 is changed due to the teeth (depth of teeth slots between each teeth) of the new key and the old one being different. Now, the rhombus-shaped structure 7 of the first lock pillar 6 moves into the teeth slot 26 of the through hole 30 of the locking tongue 25 again by the force of the second lock pillar 11. The matched position of the rhombus-shaped structure 4 and the teeth slot 26 is different to the ordinary one. After reverse rotating 90 degrees and pulling out the new key, the lockset is locked and the key is replaced. The frame body 10 and the lock column 4 are unmovable and the lock column 4 cannot be moved out from the long groove 14 of the lock shell 1. Therefore, the novel anti-theft lockset is at a locked situation, and the internal structure of the lock core 2 is difficult to destroy and the ability of anti-theft is improved.

As the description aforementioned, the key is changeable for locking/unlocking the lockset of the present invention. Therefore, elements of the lock core can be manufactured in the same way without matching the teeth of the key due to all of the elements of the lock core being the same. Moreover, the manufacturing cost is decreased by automatically manufacturing from producing lines.

Lockset of the present invention can be applied to all doors in a single family and locked/unlocked by the same key. Thus, reserved keys can be locked/unlocked the lockset of the present invention by replacing without making a new one when ordinary keys are lost. It's safe and convenient.

Although the present invention has been described in terms of specific exemplary embodiments and examples, it will be appreciated that the embodiments disclosed herein are for illustrative purposes only and various modifications and alterations might be made by those skilled in the art without departing from the spirit and scope of the invention as set forth in the following claims.

What is claimed is:

1. A novel anti-theft lockset, comprising:

a lock shell (1);

a lock core (2), being disposed in the lock shell (1), wherein the lock core (2) is a cylinder and comprises:

a key hole (3), being disposed on one end of the lock core (2);

a plurality of accommodating slots (15), being formed on one side surface of the lock core (2) and communicating with the key hole (3);

a plurality of first recess slots (17) communicating to each other, being formed on one side surface of the lock core (2), wherein each the accommodating recess (17) is communicated with the accommodating slot (15) through a communication channel;

a plurality of second recess slots (21), being formed on one side surface of the lock core (2) and respectively connected to the first recess slots (17);

a second accommodating slot (22), being formed on one side surface of the lock core (2) and adjacent to the second recess slots (21), wherein the second accommodating slot (22) is provided with a plurality of lock pillar grooves (19) in the internal thereof;

a sliding slot (18), being formed on one side surface of the lock core (2); and a frame body sliding slot (20), being formed in the sliding slot (18) of the lock core (2) and communicated with the accommodating slots (15);

a plurality of locking tongues (25), being respectively accommodated in the accommodating slots (15) for being disposed in the lock core (2), wherein each the locking tongue (25) comprises:

a through hole (30), being provided with a plurality of teeth (27);

a plurality of V-shaped grooves (26), being formed between the teeth (27); and a curve slot (24), being formed on top end of the locking tongue (25);

a plurality of first lock pillars (6), being respectively connected to the through holes (30), wherein each of the first lock pillars (6) is formed with a rhombus-shaped structure (7) on one end thereof, and the rhombus-shaped structure (7) embedding into any two V-shaped grooves (26) when the first lock pillar (6) is connected with the through hole (30);

a plurality of torsion springs (9), being respectively disposed in the first recess slots (17), wherein one end of the torsion spring (9) is disposed in the curve slot (24) of the locking tongue (25) via the communication channel between the first recess slot (17) and the accommodating slot (15), and other end of the torsion spring (9) is disposed in the second recess slot (21);

a cross bar (8), being disposed in the first recess slots (17) communicating to each other, wherein the cross bar (8) is passed through the torsion springs (9) so as to keep the torsion springs (9) in the first recess slots (17);

a lock column (4), being embedded into the sliding slot (18) and having a plurality of support pillars (5), wherein the support pillars (5) supports the first lock pillars (6) in the internal of the lock core (2); and a frame body (10), being disposed in the second accommodating slot (22) and having a plurality of second lock pillars (11), wherein the second lock pillars (11) are respectively located in the lock pillar grooves (19) for connected to the rhombus-shaped structures (7) of the first lock pillars (6).

2. The novel anti-theft lockset of claim 1, wherein an inserting hole (31) is provided on an eccentric position of the lock core (2) and communicated with the sliding slot (18).

3. The novel anti-theft lockset of claim 1, wherein the amount of the V-shaped grooves (26) is four.

4. The novel anti-theft lockset of claim 2, wherein a long groove (14) is formed on the inner wall of the lock shell (1).

5. The novel anti-theft lockset of claim 4, wherein two springs (23) are disposed between a step (29) of the sliding slot (18) and the lock column (4); therefore, when a key (12) is inserted into the key hole (3) for executing a locking operation, the springs (23) are able to push the lock column (4) moving out of the sliding slot (18) and then be arranged in the long groove (14) of the lock shell (1).

6. The novel anti-theft lockset of claim 5, wherein an first inclined plane (28) is provided on one end of the lock column (4) near the inserting hole (31); therefore, after an inserting plate (13) with an second inclined plane is inserted into the inserting hole (31), the lock column (4) would enter the sliding slot (18).

* * * * *